US009020407B2

(12) United States Patent
Hashimoto

(10) Patent No.: US 9,020,407 B2
(45) Date of Patent: Apr. 28, 2015

(54) IMAGE HEATING APPARATUS

(75) Inventor: Naoki Hashimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 13/438,166

(22) Filed: Apr. 3, 2012

(65) Prior Publication Data

US 2012/0269562 A1 Oct. 25, 2012

(30) Foreign Application Priority Data

Apr. 19, 2011 (JP) ..... 2011-093217

(51) Int. Cl.
*G03G 15/20* (2006.01)

(52) U.S. Cl.
CPC .... *G03G 15/2017* (2013.01); *G03G 2215/2035* (2013.01)

(58) Field of Classification Search
USPC ..... 399/122, 320, 321, 328, 329, 333, 335, 399/336, 338; 219/216
See application file for complete search history.

(56) References Cited

U.S. PATENT DOCUMENTS

| | | | | |
|---|---|---|---|---|
| 5,525,775 | A | 6/1996 | Setoriyama et al. | |
| 5,742,878 | A | 4/1998 | Kuroda | |
| 7,974,563 | B2 | 7/2011 | Sakai et al. | |
| 8,005,413 | B2 | 8/2011 | Sakakibara et al. | |
| 2002/0110394 | A1 | 8/2002 | Takeuchi et al. | |
| 2004/0037597 | A1 * | 2/2004 | Haseba et al. | 399/328 |
| 2005/0180788 | A1 | 8/2005 | Watanabe et al. | |
| 2008/0056755 | A1 * | 3/2008 | Koshida | 399/92 |
| 2011/0091252 | A1 | 4/2011 | Sekihara et al. | |
| 2011/0217092 | A1 | 9/2011 | Sekihara et al. | |
| 2011/0237413 | A1 | 9/2011 | Sakakibara et al. | |

FOREIGN PATENT DOCUMENTS

| | | | |
|---|---|---|---|
| CN | 1490829 | A | 4/2004 |
| CN | 1648785 | A | 8/2005 |
| JP | 4-44075 | A | 2/1992 |
| JP | 2002-117959 | A | 4/2002 |

OTHER PUBLICATIONS

Great Britain Office Action dated Aug. 10, 2012, in counterpart UK Application No. GB1206813.6.
Chinese Office Action issued in Corresponding Chinese Application No. 201210116009.X dated Aug. 25, 2014.

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image heating apparatus includes a belt member for heating in a nip an image formed on a recording material, an urging portion, contacting an inner surface of the belt member, for forming the nip, a guide portion, contacting the inner surface of the belt member at an end portion, for guiding rotation of the belt member, and a belt unit, including at least the belt member, the urging member and the guide portion, integrally detachably mountable to the image heating apparatus. The belt member is detachably mountable to the belt unit. The apparatus also includes a frame for supporting the belt unit, and a limiting portion, provided on the frame, for limiting the belt member by abutment to an edge of the belt member.

15 Claims, 11 Drawing Sheets

| FIXING FILM RADIUS R (%) | 3 | 6 | 9 | 12 | 15 |
|---|---|---|---|---|---|
| 99.9 | × | × | ○ | ○ | ○ |
| 99.5 | × | × | ○ | ○ | ○ |
| 99 | × | × | × | × | ○ |
| 98.5 | × | × | × | × | × |
| 98 | × | × | × | × | × |

FIXING FILM LENGTH L (%)

IMAGE HEATING APPARATUS

FIELD OF THE INVENTION AND RELATED ART

The present invention relates to an image heating apparatus, for heating an image, to be mounted in an image forming apparatus, such as a copying machine, a printer or a facsimile machine, which employs an electrophotographic-type process and which is capable of forming the image on a recording material. As the image heating apparatus, it is possible to use a fixing device for fixing an unfixed image formed on the recording material, a gloss-treatment heating device for improving the glossiness of the image by heating the image fixed on the recording material, and the like device.

In a conventional image forming apparatus us ing an electrophotographic-type process, a latent image formed on a photosensitive drum as an image bearing member is developed to form a visible image. Then, this visible image (toner image) is transferred onto the recording material by using an electrostatic force and then the transferred image is fixed by heat, so that the image is recorded and formed on the recording material.

With respect to the fixing device, from the viewpoints of a quick start and energy saving, a fixing device of a tension-free, film-heating type (belt-heating type) has been put into practical use (Japanese Laid-Open Patent Application (JP-A) Hei 4-44075).

In such a fixing device of the belt-heating type as the tension-free type, a constitution in which only a fixing belt is exchanged for the purpose of reducing the running cost is disclosed in JP-A 2002-117959, in which end portions of a heater and a heater holding member are sandwiched with a small-sized clip, so that an exchange property of the fixing belt is made easy.

However, even in such a constitution, a regulating portion (flange in JP-A 2002-117959), for regulating an end portion of the fixing belt, which is constituted so as to be larger than an inner diameter of the fixing belt, is required to be disconnected when the fixing belt is exchanged, so that the number of operation procedures is increased.

SUMMARY OF THE INVENTION

A principal object of the present invention is to provide an image heating apparatus with enhanced belt exchangeability.

According to an aspect of the present invention, there is provided an image heating apparatus comprising: a belt member for heating in a nip an image formed on a recording material; an urging portion, contacted to an inner surface of the belt member, for forming the nip; a guide portion, contacted to the inner surface of the belt member at an end portion, for guiding rotation of the belt member; a belt unit, including at least the belt member, the urging member and the guide portion, integrally detachably mountable to the image heating apparatus, wherein the belt member is detachably mountable to the belt unit; a frame for supporting the belt unit; and a limiting portion, provided on the frame, for limiting the belt member by abutment to an edge of the belt member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (a) of FIG. 1 is an illustration of conventional belt exchange in Comparative Embodiment, and (b) of FIG. 1 is an illustration of belt exchange in Embodiment 1.

DESCRIPTION OF THE PREFERRED EMBODIMENTS

Next, while making reference to the drawings, embodiments of the present invention will be described.

Embodiment 1

(Image Forming Apparatus)

Figure 2:
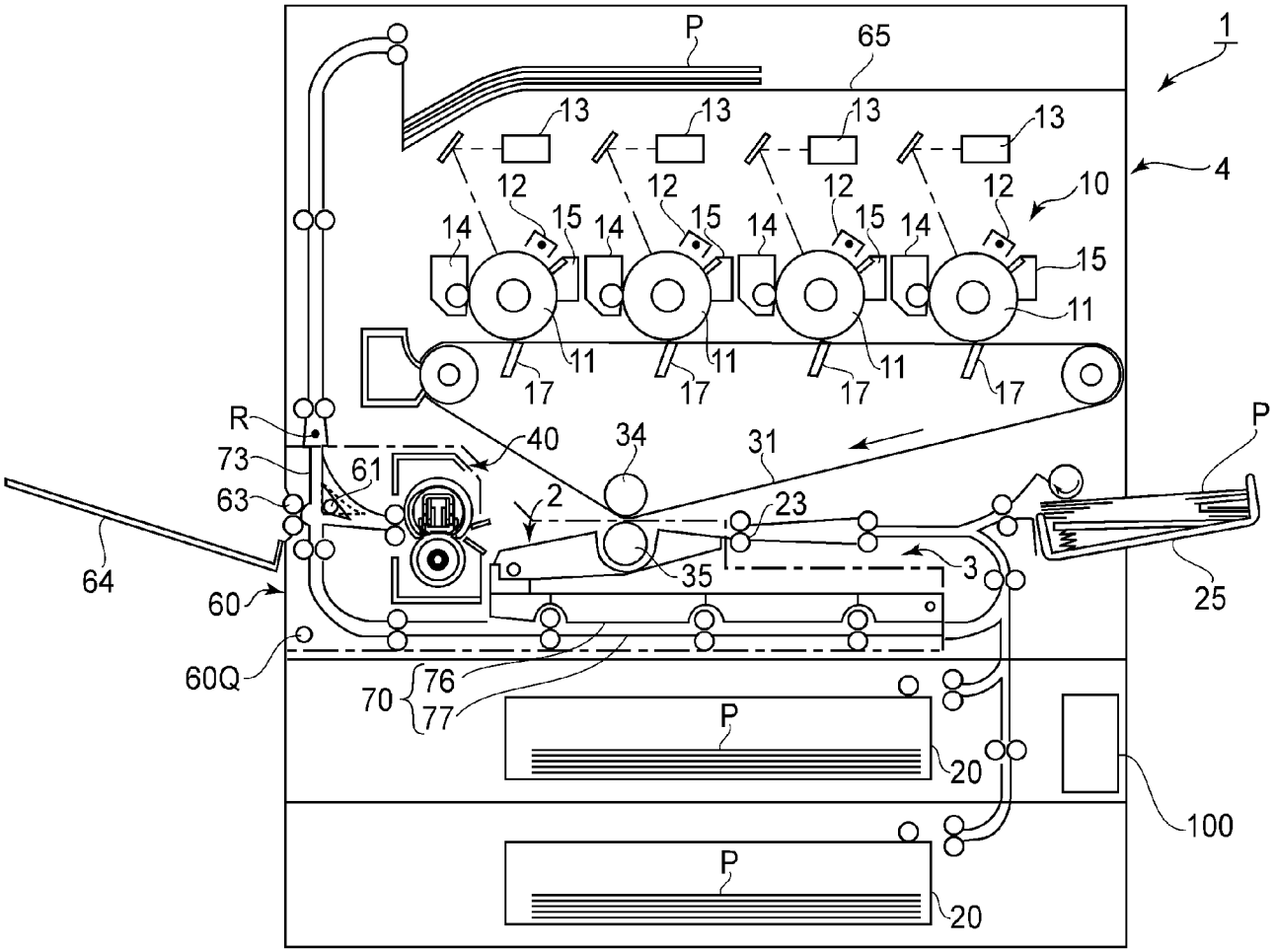
FIG. 2 is a schematic view of an image forming apparatus to which an image heating apparatus according to the present invention is mountable.

FIG. 2 is a sectional view of a color electrophotographic printer which is an example of an image forming apparatus in this embodiment. In this embodiment, the color electrophotographic printer shown in the sectional view along a sheet-conveyance (recording material) direction is simply referred to as a "printer". The recording material is a material on which a toner image is to be formed, and examples thereof may include plain paper, a resinous sheet-like material which is a substitute for the plain paper, thick paper, a film (sheet) for an overhead projector, and the like.

The printer shown in FIG. 2 includes an image forming portion 10 for respective colors of Y (yellow), M (magenta), C (cyan) and Bk (black). Photosensitive drums 11 are charged by chargers 12 in advance. Thereafter, on the photosensitive drums 11, latent images are formed by laser scanners 13. The latent images are developed into toner images by developing devices 14. The toner images on the photosensitive drums 11 are successively transferred onto, e.g., an intermediary transfer belt 31, which is an image carrying member, by primary transfer blades 17. After the transfer, toners remaining on the photosensitive drums 11 are removed by cleaners 15. As a result, the surfaces of the photosensitive drums 11 can prepare for subsequent image formation.

On the other hand, a recording material P is fed one by one from a sheet feeding cassette 20 or a multi-sheet feeding tray 25 and is sent to a registration roller pair 23. The registration roller pair 23 once receives the recording material P and in the case where the recording material P has been obliquely moved, rectifies a direction of the recording material P to a straight (correct conveyance) direction. Then, the registration roller pair 23 sends the recording material P so as to travel between the intermediary transfer belt 31 and a secondary transfer roller 35 in synchronism with the toner images on the intermediary transfer belt 31. The color toner images on the intermediary transfer belt 31 are transferred onto the recording material P by the secondary transfer roller 35 which is an example of a transferring member. Thereafter, the toner images on the recording material P are fixed on the recording material P by heating and pressing the recording material P by a fixing device 40.

In the case of forming the toner image only on one surface of the recording material P, the recording material P is discharged, through switching of a switching flapper 61, on a sheet discharge tray 64 provided on a side surface of the image forming apparatus 1 via a sheet discharging roller 63 or on a sheet discharge tray 65 provided at an upper surface of the image forming apparatus 1. In the case where the switching flapper 61 is located at a position of a broken line, the recording material P is discharged on the sheet discharge tray 64 with face up (with the toner image upward). In the case where the switching flapper 61 is located at a position of a solid line, the recording material P is discharged on the sheet discharge tray 65 with face down (with the toner image downward).

In the case of forming the toner image on both surfaces of the recording material P, the recording material P on which the toner image has been fixed by the fixing device 40 is guided upward by the switching flapper 61 located at the position of the solid line. Then, when a trailing end of the recording material P reaches a reversing point R, the recording material P is switch back-conveyed along a conveying path 73 to be reversed. Thereafter, the recording material P is conveyed along a conveying path 70 for both-side (surface) image formation and then is subjected to the same process as that in the case of one-side (surface) image formation, so that the toner image is formed on the other surface of the recording material P and then the recording material P is discharged on the sheet discharge tray 64 or on the sheet discharge tray 65. A portion constituted by the flapper 61, the switch back-conveying path 73 and the like is an example of a reversing means.

(Image Heating Apparatus)

A schematic structure of the fixing device 40 of a belt-heating type in this embodiment will be described with reference to FIGS. 2, 3 and 4. In this embodiment, in order to fix the toner image on the recording material P from the viewpoints of a quick start and energy saving, the fixing device 40 is of the belt-heating type. In FIG. 2, the fixing device 40 includes a fixing belt 44, which is rotationally movable and is capable of being heated by a heater. The fixing belt 44 is a thin endless belt and as a transfer material, polyimide, polyamide, fluorine-containing resin, metal and the like can be used.

Incidentally, in order to ensure releasability (a parting property) with respect to the toner T (toner image), a surface layer of the fixing belt 44 can comprise a parting layer of PFA (tetrafluoroethylene-perfluoroalkylvinyl ether copolymer resin). Or, it is also possible to form the parting layer of polyimide, polyetherimide, PES (polyether sulfide) or the like. By using a fixing belt with a low thermal capacity as the fixing belt 44, it is possible to provide an on-demand fixing device with a very short rising time.

Figure 3:
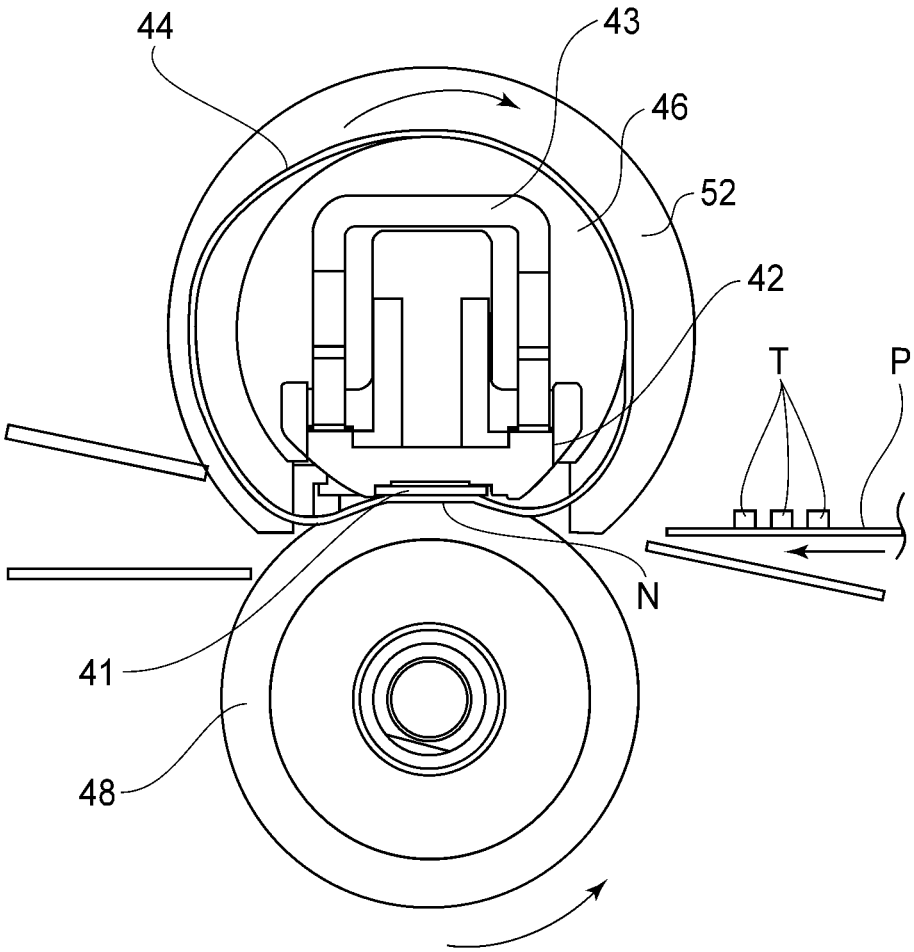
FIG. 3 is a sectional view with respect to a (recording material) conveyance direction of a fixing device as an example of the image heating apparatus according to the present invention.
Figure 4:
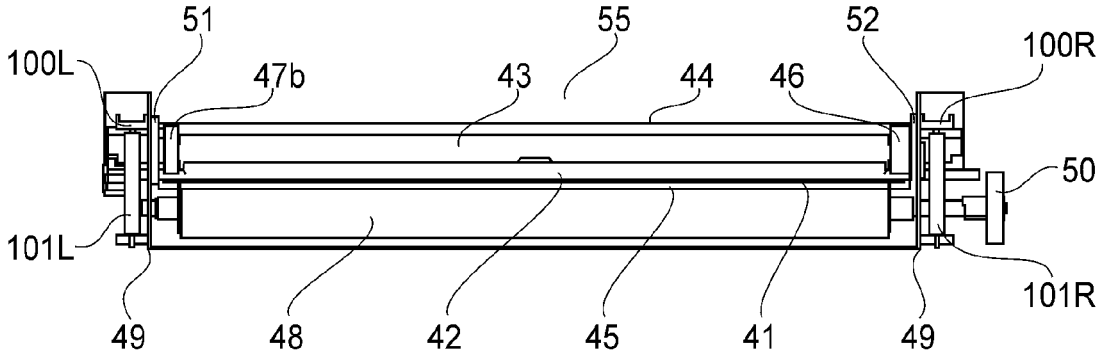
FIG. 4 is a sectional view with respect to a longitudinal direction of the fixing device as the example of the image heating apparatus according to the present invention.

In FIGS. 3 and 4, at one side (inner peripheral surface side) of the fixing belt 44, a heater 41 as a heating means for heating the belt contacts the fixing belt 44, and at the other side, a pressing roller 48 press-contacts the fixing belt 44. The heater 41 and a holding member 42 for supporting the heater are constituted as a back-up member. Further, a stay 43 for fixing the holding member 42 is provided. The holding member 42 contacts an inner surface of the belt at its end portions to hold guide members 46 and 47*b* ((b) of FIG. 1) for guiding a locus of the belt during rotational movement of the belt, thus being constituted as a fixing belt unit 55. The fixing belt unit 55 is fixed on a side plate 49 of the fixing device 40. The fixing belt 44 is urged by the heater 41, so that a nip N is formed between itself and the pressing roller 48 which is rotationally movable.

The heater has a basic structure including an elongated, thin, plate-like ceramic substrate and an energization, heat-generating resistor layer provided on the substrate surface and is a low thermal-capacity heater, which is increased in temperature with an abrupt rising characteristic as a whole by energization to the heat-generating resistor layer.

The pressing roller 48 has a pressing roller gear 50, and the pressing roller gear 50 is rotationally driven in an arrow direction in FIG. 3, receiving a driving force from an unshown transmission mechanism. By rotating the pressing roller 48, the fixing belt 44 can be rotated, so that the fixing belt 44 heated by the heater 41 conveys the toner T on the recording material P into the nip and heat-presses the recording material P in the nip to fix the toner T on the recording material P.

In the fixing device of the belt-heating type, the fixing belt 44 and the heater 41 slide with each other while being pressed and therefore as a lubricant, e.g., a heat-resistant fluorine-containing grease or the like is applied onto the heater surface in general. In FIG. 4, before the fixing belt 44 is mounted in the fixing belt unit 55, a heat-resistant grease is uniformly applied in the same amount onto the heater 41 with respect to the longitudinal direction. By this operation, the sliding resistance between the surfaces of the fixing belt 44 and the heater 41 can be reduced, so that it is possible to prevent various problems, such as improper sheet feeding due to improper rotation of the fixing belt 44 and the occurrence of an image defect due to abrasion (wearing) of the inner surface of the fixing belt 44.

Further, the fixing belt 44 rotated by the rotation of the pressing roller 48 receives a lateral-shift force with respect to the longitudinal direction in FIG. 4, thus being moved in the longitudinal direction in general. The principal reason why the lateral-shift force is generated can vary, such that misalignment between the fixing belt 44 and the pressing roller 48 occurs due to variations in the dimension of various fixing-device constituting members or such that the difference in the outer diameter of the pressing roller 48 between left and right end portions or the difference in peripheral speed due to a temperature non-uniformity of the fixing belt 44 with respect to the longitudinal direction is caused to occur.

For these reasons, in order to keep the fixing belt 44 at a predetermined position when the fixing belt 44 is moved in the longitudinal direction, lateral-belt-shift preventing (limiting) members 51 and 52, having a diameter larger than the outer diameter of the fixing belt 44, for preventing lateral shift of (or for limiting) end portions of the fixing belt 44 are provided. In this embodiment, the guide member 46 provided at the right side in FIG. 4 is constituted integrally with the lateral-belt-shift preventing member 52, but the guide member 47*b* provided at the left side is constituted so as to be separated from the lateral-belt-shift preventing member 51.

The separation structure between the lateral-belt-shift preventing member 51 and the guide member 47*b* will be specifically described separately.

(Urging Mechanism)

An urging (pressing) mechanism for the pressing roller and the back-up member is shown in FIG. 4. The pressing roller 48 and the heater holding member 42 as the back-up member are urged toward each other via the fixing belt 44, which is subjected to locus (or bit) regulation by locus regulating portions 46 and 47*b* in the following manner. At the longitudinal end portions, urging members 100L and 100R press-contact springs 101L and 101R toward the locus regulating portions 47*b* and 46, respectively, so that pressure is applied to the heater holding member 42.

(Fixing Belt Exchange)

Figure 1:
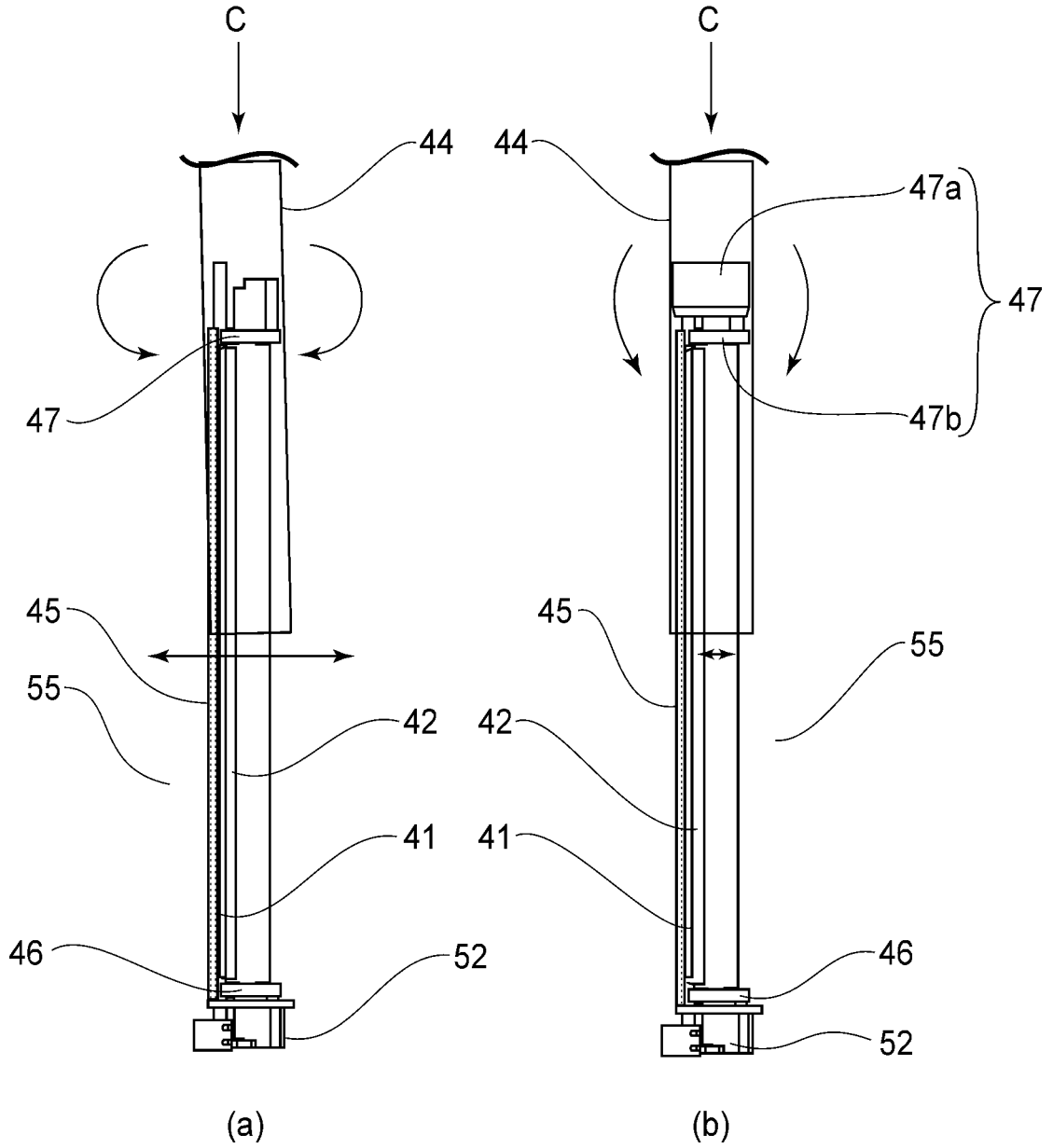
Figure 5:
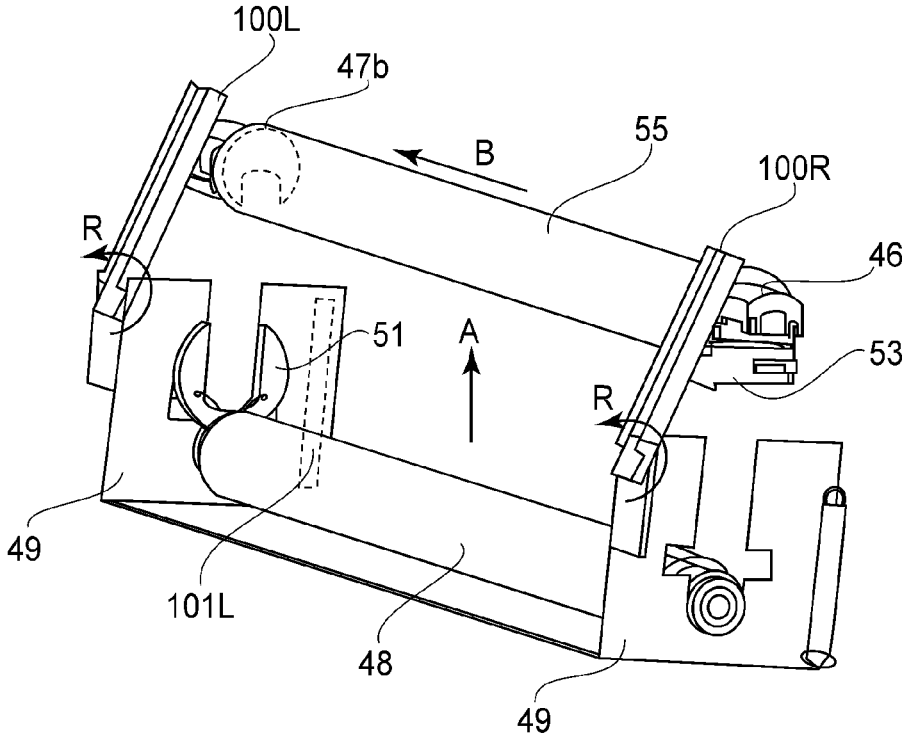
FIG. 5 is a perspective view when a fixing belt unit is taken out from the fixing device.

Next, an exchanging (replacing) method when a fixing-belt exchanging operator, such as a service person actually exchanges (replaces) the fixing belt 44 in this embodiment will be described with reference to FIGS. 1 and 5. In FIG. 5, during the belt exchange, the urging members 100L and 100R are released (disconnected) from the press-contact springs 101L and 101R, respectively, thus being rotated in arrow R directions, which are a rotational movement direction, so that the fixing belt unit 55 is released from the application of pressure.

(Belt Exchange in this Embodiment)

1) Demounting of Old Belt to be Exchanged

In FIG. 5, the fixing belt unit 55 pressure-released from the above-described urging mechanism is taken out in an arrow A direction. At that time, the above-described lateral-belt-shift preventing member 51 is constituted so as to remain on the side plate 49 of the fixing device 40. The locus regulating portion 47*b* provided at one longitudinal side of the fixing belt 44 is separable from the lateral-belt-shift preventing member 51 (fixed on the side plate of the fixing device as the image heating apparatus). Thereafter, the fixing belt is demounted in an arrow B direction and then a new fixing belt 44 is mounted. On the other hand, the lateral-belt-shift preventing member 52 at the other longitudinal side of the fixing belt 44 is formed integrally with the locus regulating portion 46. By employing such a constitution, the longitudinal position of the fixing belt 44 can be regulated. Further, in this embodiment, an electric energy supply portion 53 for supplying electrical energy to the heater is provided at a side of the lateral-belt-shift preventing member 52. Incidentally, in this embodiment, electrical energy supply to the heater is effected only from the electric energy supply portion 53. For that reason, at an end portion of the heater at the side where a belt mounting guide portion 47*a*, described later, is provided, the electrical energy-supply portion is not mounted.

Here, an advantage in exchangeability of the fixing belt 44 in the above-described constitution will be described. In the fixing device of the conventional belt-heating type as the tension free type, the lateral-belt-shift preventing member 51 and the guide member 47*b* are constituted as an integral part in general. As described above, in order to regulate the widthwise position of the fixing belt 44 in contact with the end portion of the fixing belt when the fixing belt 44 is moved in the longitudinal direction, the lateral-belt-shift preventing member 51 is required to have the diameter larger than the outer diameter of the fixing belt 44.

For that reason, when the lateral-belt-shift preventing member 51 is constituted as the integral part with the guide member 47*b* during the demounting of the fixing belt 44 in the arrow B direction in FIG. 5, the fixing belt 44 cannot be demounted. Therefore, there arose a problem such that an operation process was increased since generally the fixing belt 44 was demounted after demounting the guide member 47*b*. As in this embodiment, by employing the constitution in which the lateral-belt-shift preventing member 51 as the end portion regulating (limiting) portion remains on the side plate 49 of the fixing device 40, there is no need to demount the lateral-belt-shift preventing member 51 before the fixing belt 44 is demounted, so that a cumbersome operation is eliminated.

2) Mounting of New Belt

The belt exchange in this embodiment will be described with reference to (b) of FIG. 1. At one longitudinal end portion, the belt mounting guide portion 47*a* for the belt exchange is provided closer to the end portion than the belt locus regulating portion 47*b*. At the other longitudinal end portion, the belt locus regulating portion 46 having the same shape as the belt locus regulating portion 47*b* on the locus surface is provided, so that the belt locus regulating portions 46 and 47*b* are integrally held by the heater holding member 42.

Next, a shape of the belt mounting guide portion 47*a* will be described. As described above, the peripheral length of the belt locus regulating portion 47*b* is designed so as to be smaller than the peripheral length of the fixing belt generally by 3% to 10%. On the other hand, the belt mounting guide portion 47*a* has a diameter larger than that of the belt locus regulating portion 47*b* and has the peripheral length smaller than that of the fixing belt 44 by 0.1% to 0.5%. That is, the peripheral length of the belt mounting guide portion 47*a* is larger than that of the belt locus regulating portion 47*b* and is smaller than that of the fixing belt 44. Further, the belt mounting guide portion 47*a* is mounted in parallel to the heater 41. The peripheral length of the belt mounting guide portion 47*a* is slightly smaller than the peripheral length of the fixing belt 44 and therefore the fixing belt 44 is mounted along the belt mounting guide portion 47*a*, i.e., is mounted so as to be pushed in substantially in parallel to the heater 41, and therefore a degree of inclination of the fixing belt 44 relative to the heater 41 is small.

When the fixing belt 44 is gradually inserted, a fixing belt leading (front) end with respect to the mounting direction passes through the belt mounting guide portion 47*a* and then abuts against the belt locus regulating portion 52. Further, a fixing belt trailing (rear) end with respect to the mounting direction is regulated in locus by the belt locus regulating portion 47*b*. Thus, in the belt exchange in this embodiment, at one longitudinal end side, the guide member 47 has two-level shapes of the belt mounting guide portion 47*a* and the belt locus regulating portion 47*b*. As a result, it was possible to prevent the inclination of the fixing belt 44 during the mounting of the fixing belt 44 and it was also possible to prevent scraping-off of the heat-resistant grease 45 as the lubricant.

(Belt Exchange in Comparative Embodiment)

With reference to (a) of FIG. 1, as Comparative Embodiment, conventional belt exchange in which a new fixing belt 44 is mounted in a fixing belt unit 55 in a state in which the heat-resistant grease 45 is applied onto the rear surface (belt contact surface) of the heater 41 will be described. The guide member 47 and the guide member 46 provide a bilateral symmetrical shape in a belt locus surface, and their peripheral lengths are set at a value smaller than the peripheral length of the fixing belt 44 (FIG. 3).

When the fixing belt 44 and the pressing roller 48 form the nip, the fixing belt 44 deforms in a shape following the pressing roller 48 (FIG. 3). For this reason, when the belt locus regulating portions 46 and 47 are not smaller in peripheral length than the fixing belt 44, pressure with respect to a circumferential direction is applied to the fixing belt 44, thus leading to breakage of the fixing belt 44. For this reason, the peripheral length of the guide member 47 is set at a value smaller than the peripheral length of the fixing belt 44 generally by 3% to 10%. For that reason, when the fixing belt 44 is mounted while being inclined toward an arrow C direction (in a left-right direction) in (a) of FIG. 1, the fixing belt 44 can be inclined in rotating arrow directions, so that there is a possibility that the end portion of the fixing belt 44 scrapes off the heat-resistant grease 45 applied onto the heater 41.

(Shape of Belt Mounting Guide Portion 47*a*)

Figures 6, 7:
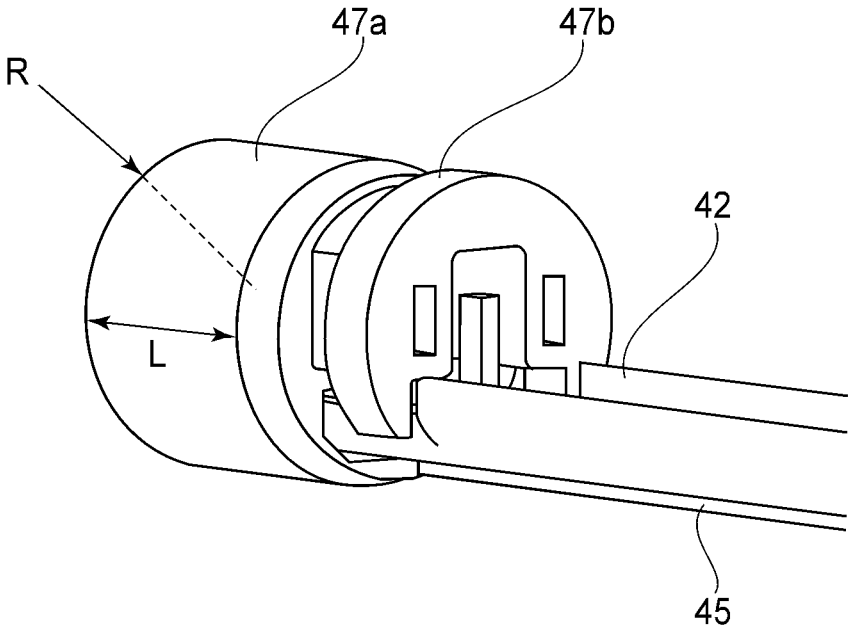
FIG. 6 is an illustration of a detailed structure of a belt mounting portion.
FIG. 7 is an illustration showing a belt-mounting experiment result.

Next, the shape of the belt mounting guide portion 47*a* will be described with reference to FIGS. 6 and 7. In FIG. 6, a length of the belt mounting guide portion 47*a* in a direction parallel to a belt mounting direction is L, and a radius of the belt mounting guide portion 47*a* in a direction perpendicular to the belt mounting direction is R. In this case, when the length L is excessively short, the fixing belt 44 cannot be mounted in a direction parallel to the heater 41 and the fixing belt mounting direction, so that the grease is scraped off by the end of the fixing belt 44. Further, when the radius R is excessively small, similarly, there is a possibility that the end of the fixing belt 44 scrapes off the grease.

Therefore, an experiment as described below was conducted. Lengths of 5 types of belt mounting guide portions 47*a* were set from 3% to 15%, with an increment of 3%, of the length of the fixing belt 44. Further, sizes of 5 types of belt mounting guide portions 47*a* were set so that radii R were 98% to 99.9%, with an increment of 0.5% (or 0.4% for the largest belt mounting guide portion), of the inner diameter of the fixing belt 44.

Guide members including 25 types of the belt mounting guide portion 47*a* in a 5 (types of L)×5 (types of R) matrix were prepared and were subjected to an experiment as to whether or not the fixing belt 44 scraped off the heat-resistant grease 45. Further, whether or not the heat-resistant grease 45 was scraped off by the fixing belt 44 was evaluated from a value of the heat-resistant grease 45 deposited on (adhered to) the fixing belt 44 at two levels of "o" and "x". In the case where the deposited amount of the heat-resistant grease 45 on the fixing belt 44 exceeds 0.1% of the amount of the heat-resistant grease 45 applied onto the heater 45, the level was evaluated as "x", and in the case where the deposited amount is below 0.1% of the application amount, the level was evaluated as "o".

FIG. 7 is a graph showing a result of the above experiment conducted in the above-described manner. In the experiment result of FIG. 7, the abscissa represents the percentage of the length L with respect to the fixing belt length, and the ordinate represents the percentage of the radius R with respect to the fixing belt radius. From the experiment result, it was understood that a region in which the level was "o" included a region of the (L/fixing belt length) percentage of 9% or more and a region of the (R/fixing belt radius) percentage of 99.5% or more. Therefore, the above condition was set as a design requirement.

Embodiment 2

In Embodiment 1, the fixing device of the heater heating type was used, but in this embodiment, a fixing device of an electromagnetic-induction-heating type is used. There is a possibility that also in the fixing device of the electromagnetic induction heating type, the lubricant is applied and therefore is scraped off by the belt, but a guide member provided with a belt mounting guide portion is provided and thus the above problem can be solved.

Figure 8:
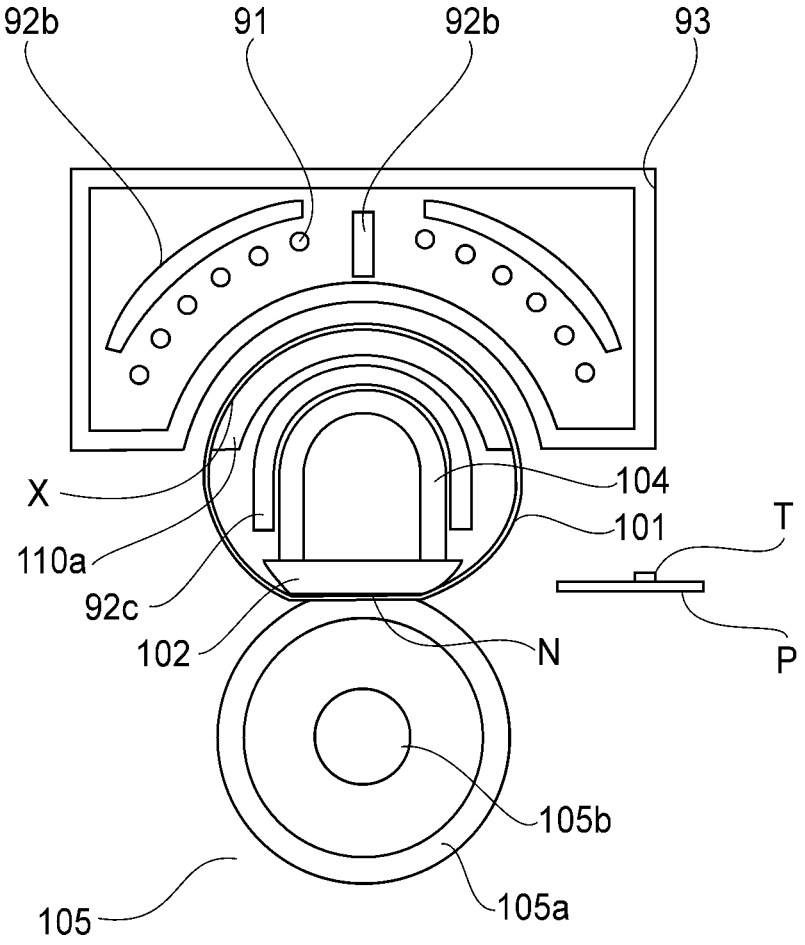
FIG. 8 is a sectional view of a fixing device of electromagnetic heating type in Embodiment 2.

FIG. 8 is a sectional view of the fixing device of the electromagnetic induction heating type. In this embodiment, in the belt-heating type, a thin fixing belt 101 having an electroconductive layer is constituted so as to be induction-heated externally by a magnetic field-generating means 93. The magnetic field generating means 93 is a member formed in an elongated shape in a longitudinal direction, perpendicular to a rotational direction of the fixing belt 101, and is provided outside the fixing belt 101, as a member to be heated, with a certain gap.

In this embodiment, the magnetic field generating means 93 includes an exciting coil 91 and a coil supporting member or holder also denoted by reference numeral 93. Further, the magnetic field generating means 93 includes a core material 92*b* which is provided at a center portion of the exciting coil 91 and which is formed of a ferromagnetic material, and includes a core material 92*c*, which is provided at a side opposite from the exciting coil 91 via the fixing belt 101 and which is formed of the ferromagnetic material. These members 91, 93, 92*b* and 92*c* constitute the magnetic field generating means 93. The coil 91 has a substantially (elongated) elliptical shape extending in the longitudinal direction and is disposed inside the holder 93 so as to follow the outer peripheral surface of the fixing belt 101.

As a wire core of the coil 91, Litz wire prepared by bundling approximately 80-160 strands of fine wires having a diameter of 0.1-0.3 mm is used. As the fine wires, insulation coating electric wires are used. Further, the Litz wire is wound 8 to 12 times around the magnetic core 92*b* to constitute the coil 91 to be used. To the coil 91, an exciting circuit is connected so that an alternating current can be supplied to the coil 91. The magnetic core 92*b* is configured to surround a winding-center portion and a periphery of the coil 91. The magnetic core 92*b* has the function of efficiently introducing AC magnetic flux generated from the coil 91 into an induction heat-generating element constituting the fixing belt 101. That is, the magnetic core 92*b* is used for enhancing an efficiency of a magnetic circuit and for magnetic shielding. In this embodiment, the magnetic core 92*c* formed of the ferromagnetic material is provided inside the fixing belt 101 so as to oppose the magnetic core 92*b* via the fixing belt 101. As a material for the magnetic cores 92*b* and 92*c*, those such as ferrite having high magnetic permeability and low residual magnetic-flux density may preferably be used. By using ferromagnetic metal (metal having high magnetic permeability) such as iron as the material for the fixing belt 101 as the induction heat-generating element, it is possible to confine a larger amount of the magnetic flux generated from a magnetic-flux generating means within the metal.

The coil 91 generates the AC magnetic flux, by the AC current supplied from the exciting circuit, which is introduced into the magnetic core 92*b* to generate the eddy current in the fixing belt 101 as the induction heat-generating element. The eddy current generates Joule heat by the specific resistance of the induction heat-generating element. That is, by supplying the AC current to the coil 91, the fixing belt 101 is placed in an electromagnetic-induction, heat-generation state. A fixing pad 102 is used as a back-up member for assisting formation of a pressure profile in the nip. Further, the fixing pad 102 is fixed by a stay 104. A guide member 110*a* supports the fixing belt 101 from the inside at end portions of the fixing belt 101 and has a function of guiding the locus of the fixing belt 101.

A heat-resistant elastic pressing roller 105 as a pressing member includes a metal core 105*b* and an elastic layer 105*a* formed with a heat-resistant rubber such as a silicone rubber or a fluorine-containing rubber or with a foam member of the silicone rubber, and is provided while being supported by bearings (not shown) at end portions of the metal core 105*b*. At an upper side of the pressing roller 105, the above-described assembly of the fixing pad 102, the guide member 110*a*, the fixing belt 101 and the stay 104 is disposed parallel to the pressing roller 105 with the fixing pad 102 downward.

By urging the stay 104 downward by an urging member (not shown), the fixing pad 102 press-contacts the fixing belt 101 toward the elastic layer of the pressing roller 105 to form a fixing nip N, with a predetermined width, as a heating portion. The eddy current is generated at the metal surface to heat the fixing belt 101 to a fixable temperature, and by rotating the pressing roller 105, the fixing belt 101 is rotated, and then the recording material P is nip-conveyed in the fixing nip N. An unfixed toner T on the recording material P is fixed.

Further, a heat-resistant grease is applied onto the fixing pad 102. Also in the above-described fixing device of the electromagnetic-induction-heating type, there is a possibility that the heat-resistant grease is scraped off by the fixing belt 101. However, at one longitudinal end of the fixing belt 101, a belt mounting guide portion 47*a* is provided. Further, a lateral-belt-shift preventing member at the belt mounting guide portion 47*a* side is fixed on the side plate of the fixing device. Further, a lateral-belt-shift preventing member at the other longitudinal end of the fixing belt 101 is not fixed in the fixing device but is formed integrally with the guide member and is fixed on the fixing pad 102. In this embodiment, a constitution in which the induction heating is effected by using the coil without using the heater is employed but even in such a constitution, an effect similar to that in Embodiment 1 can be obtained.

Embodiment 3

In Embodiments 1 and 2, the above-described lateral-belt-shift preventing member 51 is fixed on the side plate 49 of the fixing device 40 and remains as it is when the fixing belt unit 55 is taken out, but it is desirable that the guide member 47*b* and the lateral-belt-shift preventing member 51 are constituted so as not to cause deviation of their relative positional relation. In Embodiment 3, positioning of the guide member 47*b* and the lateral-belt-shift preventing member 51 will be described.

Figure 9:
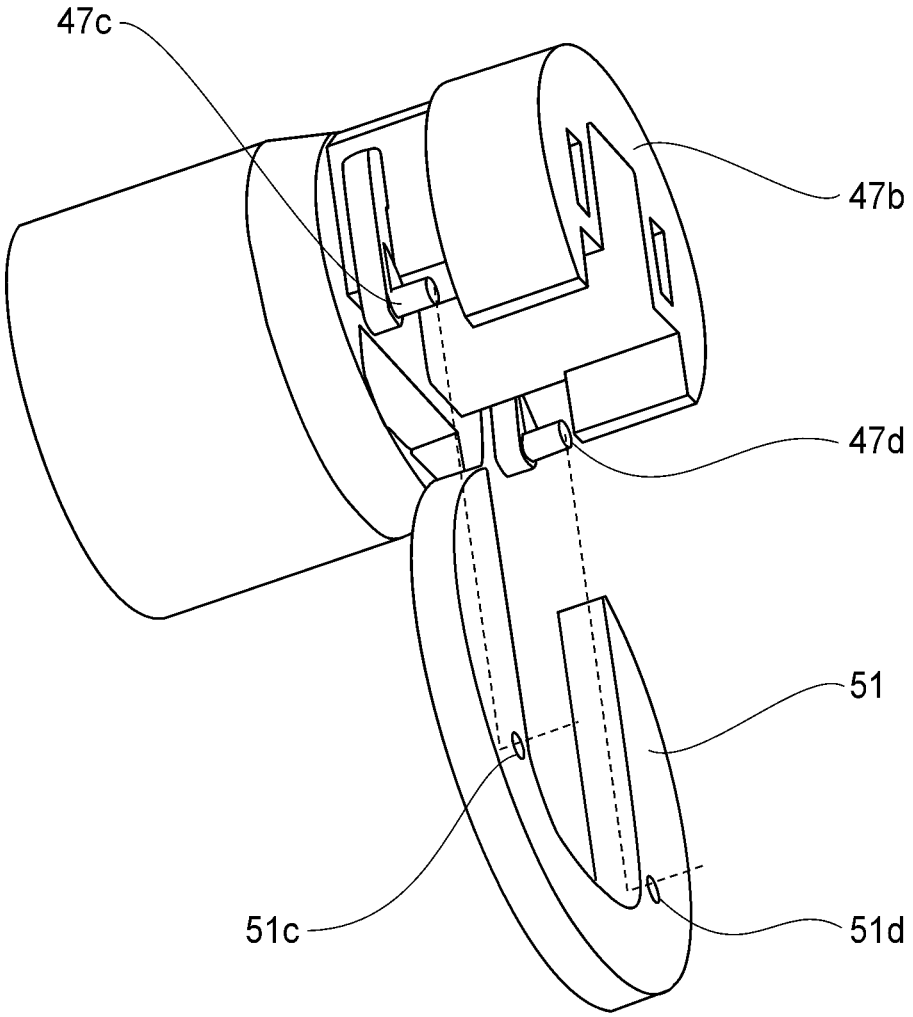
FIG. 9 is an illustration regarding positioning between an end portion regulating (limiting) portion and a locus regulating portion in Embodiment 3.

In FIG. 9, the guide member 47*b* is provided with claws 47*c* and 47*d* for being positioned relative to the lateral-belt-shift preventing member 51. Further, the lateral-belt-shift preventing member 51 is provided with holes 51*c* and 51*d* for being positioning-engaged with the claws 47*c* and 47*d* of the guide member 47*b*.

Figure 10:
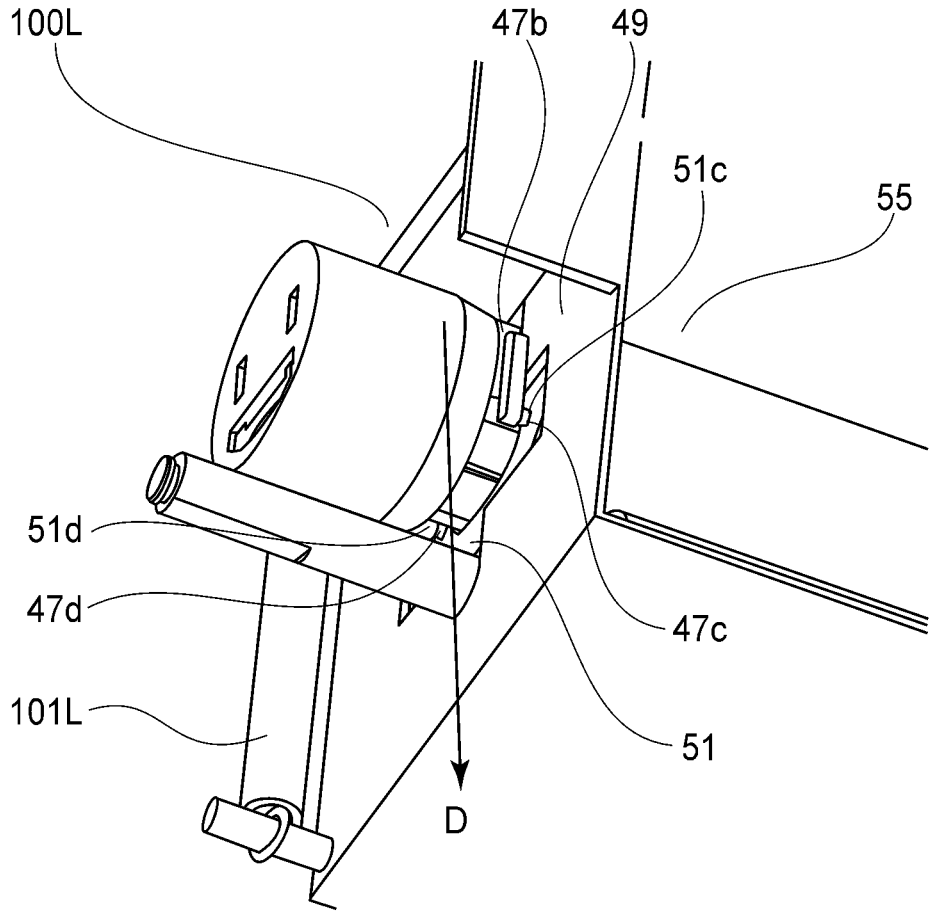
FIGS. 10 and 11 are illustrations of devices each regulating positioning between an end portion regulating portion and a locus regulating portion (member) when a fixing belt unit is mounted in a fixing device in Embodiment 3.

FIG. 10 is an enlarged perspective view showing a left end portion of the fixing device shown in FIG. 4 as seen from a left-front side. When the fixing belt unit 55 is inserted into an arrow D direction in FIG. 10, the claws 47*c* and 47*d* are pushed by the side plate 49 and gradually enter while being flexed. Thereafter, when the fixing belt unit 55 is urged by an urging mechanism constituted by an urging member 100L in an urging direction (the arrow D direction) via a press-contact spring 101L, the claws 47*c* and 47*d* are engaged in the holes 51*c* and 51*d*.

Figure 11:
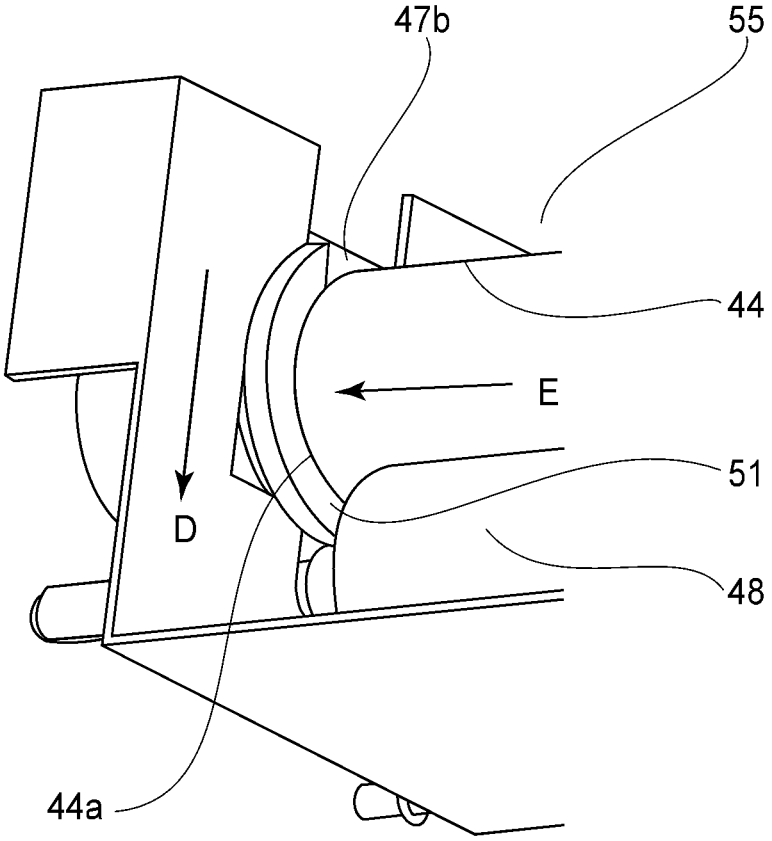

FIG. 11 is an enlarged perspective view showing the left end portion of the fixing device shown in FIG. 4 as seen from a right-front side. In FIG. 11, in order to absorb the influence of thermal expansion of the diameter of the pressing roller 48 and the influence of the thickness of the recording material P, even when the fixing belt unit 55 causes parallel motion in a direction parallel to the urging direction (the arrow D direction), the lateral-belt-shift preventing member is engaged with the guide member 47*b* and therefore the relative positional relation between the both members is not deviated. As a result, relative to the guide member 47*b*, the lateral-belt-shift preventing member 51 is not moved and therefore the fixing belt 44 does not receive the combined stress of a force acting in a lateral-shift direction (arrow E direction) and a force acting in the movement direction (arrow D direction) parallel to the urging direction. Therefore, it is possible to alleviate problems, such as buckling and abrasion of the fixing belt end portion 44*a*.

Figure 12:
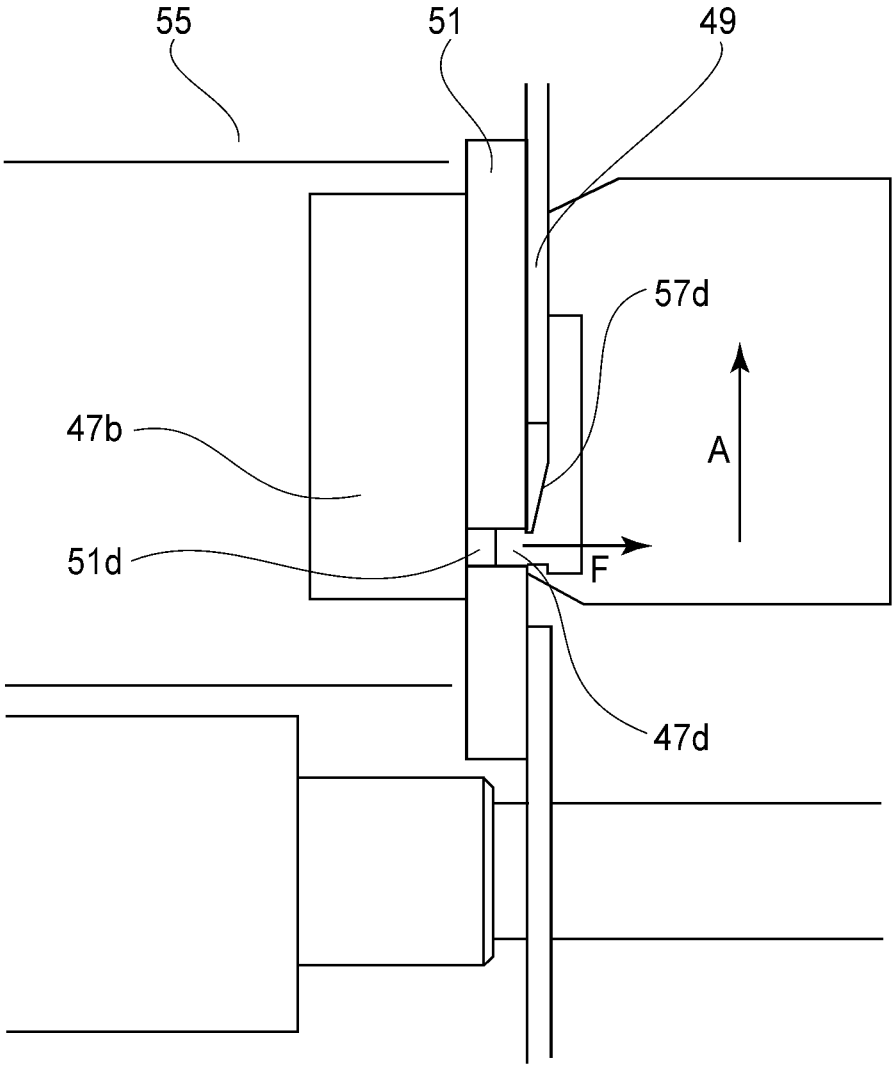
FIG. 12 is an illustration regarding a separation structure between the end portion regulating portion and the locus regulating portion when the fixing belt unit is demounted from the fixing device in Embodiment 3.

With reference to FIG. 12, a demounting mechanism for demounting the guide member 47*b* and the lateral-belt-shift preventing member 51 when the fixing belt unit 55 is pulled out in an arrow A direction will be described. The claw 47*d* of the guide member 47*b* has an inclined surface 57*d*. When the fixing belt unit 55 is pulled out in the arrow A direction, the claw 47*d* is moved in an arrow F direction along the inclined surface 57*d* and is disengaged from the hole 51*d* of the lateral-belt-shift preventing member 51, so that the lateral-belt-shift preventing member 51 and the guide member 47*b* are separated from each other.

As described above, according to this embodiment, the lateral-belt-shift preventing member 51 is constituted so as to remain on the side plate 49 in a series of operations for demounting the fixing belt unit 55 from the side plate 49, so that there is no need to demount the guide member 47*b* and the lateral-belt-shift preventing member 51 before the fixing belt 44 is demounted from the fixing belt unit 55. Thus, a cumbersome operation is eliminated.

Embodiment 4

Next, Embodiment 4 will be described.

Figure 13:
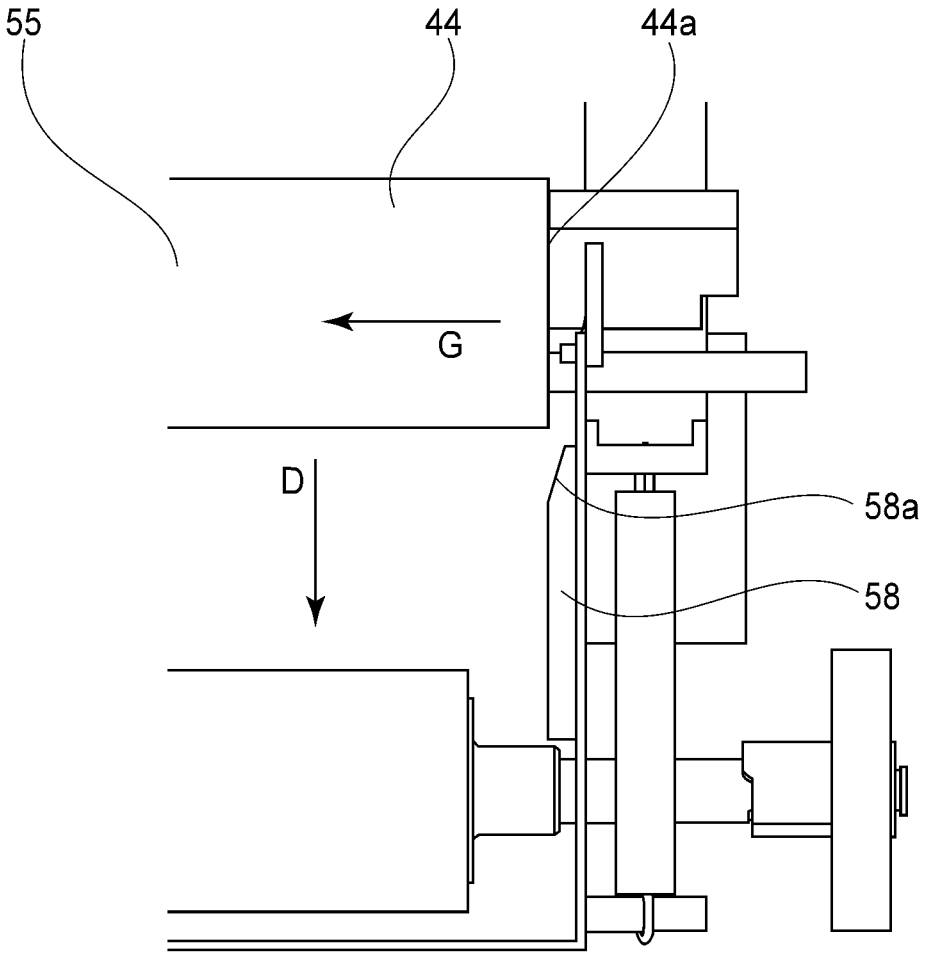
FIG. 13 is an illustration of an end portion regulating portion when a fixing belt unit is mounted in a fixing belt in Embodiment 4.

FIG. 13 shows the shape of a lateral-belt-shift preventing member 58 in this embodiment. When the fixing belt unit 55 is inserted into an arrow D direction to be mounted, there is a possibility that the end portion 44*a* of the fixing belt 44 is damaged by an edge of the lateral-belt-shift preventing member 58. Therefore, in this embodiment, the edge portion of the lateral-belt-shift preventing member 58 has an inclined surface 58*a* as shown in FIG. 15. By providing the inclined surface 58*a*, the fixing belt 44 is moved in an arrow G direction along the inclined surface 58*a* when the fixing belt unit 55 is mounted with respect to an arrow D direction, so that the fixing belt unit 55 can be mounted without damaging the fixing belt end portion 44*a* by the edge portion of the lateral-belt-shift preventing member 58.

Incidentally, in the above-described embodiments, the lateral-belt-shift preventing member is fixed on the side plate of the fixing device, but may also be fixed in a manner that it is demountable from the side plate of the fixing device.

Further, in the embodiments described above, the constitution in which the lateral-belt-shift preventing member and the guide member are separable at one end side is employed, but a constitution in which the lateral-belt-shift preventing member and the guide member are separable at both end sides may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 093217/2011 filed Apr. 19, 2011, which is hereby incorporated by reference.

What is claimed is:

1. An image heating apparatus comprising:

(i) an endless belt;

(ii) a drive rotatable member configured to (a) drive said endless belt and (b) form a nip portion, in which a toner image on a recording material is heated, cooperatively with said endless belt;

(iii) a flange portion provided at a position adjacent to a longitudinal end of said endless belt, said flange portion including, (iii-i) a guiding portion, provided within said endless belt and configured to guide rotation of said endless belt; and (iii-ii) a limiting portion provided outside of said endless belt and configured to limit a movement of said endless belt in a longitudinal direction thereof by abutment to the longitudinal end of said endless belt;

(iv) a mounting portion; and (v) a belt unit, including at least said endless belt, detachably mountable to said mounting portion, wherein said flange portion is separable into said guiding portion and said limiting portion with a dismounting operation of said belt unit from said mounting portion so that said guiding portion is dismounted integrally with said belt unit from said mounting portion while leaving said limiting portion on said mounting portion.

2. An image heating apparatus according to claim 1, wherein said flange portion includes a connecting portion configured to connect said guiding portion and said limiting portion to each other with a mounting operation of said belt unit to said mounting portion.

3. An image heating apparatus according to claim 1, further comprising:

another guiding portion provided within said endless belt and configured to guide rotation of said endless belt at a position adjacent to the other longitudinal end of said endless belt; and another limiting portion provided outside of said endless belt and configured to limit a movement of said endless belt in the longitudinal direction by abutment to the other longitudinal end of said endless belt, wherein said another guiding portion and said another limiting portion are integrally molded.

4. An image heating apparatus according to claim 1, further comprising a pad provided in said endless belt and configured to (a) press said endless belt toward said drive rotatable member and (b) support said flange portion, wherein said pad is dismounted integrally with said belt unit from said mounting portion with the dismounting operation.

5. An image heating apparatus according to claim 4, wherein said pad includes a heater configured to heat said endless belt.

6. An image heating apparatus according to claim 4, further comprising a coil configured to generate a magnetic flux for electromagnetic induction heating of said endless belt.

7. An image heating apparatus according to claim 1, wherein a dismounting direction of said belt unit from said mounting portion is a direction crossing the longitudinal direction of said endless belt.

8. An image heating apparatus according to claim 1, wherein said drive rotatable member is a roller.

9. An image heating apparatus comprising:

(i) a drive rotatable member;

(ii) a mounting portion;

(iii) a belt unit detachably mountable to said mounting portion, said belt unit including, (iii-i) an endless belt configured to (a) form a nip portion, in which a toner image on a recording material is heated, cooperatively with said drive rotatable member and (b) be driven by said drive rotatable member; and (iii-ii) a guiding portion provided within said endless belt and configured to guide rotation of said endless belt at a position adjacent to a longitudinal end of said endless belt; and (iv) a limiting portion provided on said mounting portion so as to be left on said mounting portion when said belt unit is dismounted from said mounting portion and configured to limit a movement of said endless belt in a longitudinal direction thereof by abutment to the longitudinal end of said endless belt, wherein said guiding portion is connected to said limiting portion with a mounting operation of said belt unit to said mounting portion so as to position said guiding portion relative to said mounting portion through said limiting portion.

10. An image heating apparatus according to claim 9, further comprising:

another guiding portion provided within said endless belt and configured to guide rotation of said endless belt at a position adjacent to the other longitudinal end of said endless belt; and another limiting portion provided on said mounting portion so as to be left on said mounting portion when said belt unit is dismounted from said mounting portion and configured to limit a movement of said endless belt in the longitudinal direction by abutment to the other longitudinal end of said endless belt, wherein said another guiding portion and said another limiting portion are integrally molded.

11. An image heating apparatus according to claim 9, further comprising a pad provided within said endless belt and configured to (a) press said endless belt toward said drive rotatable member and (b) support a flange portion, wherein said pad is dismounted integrally with said belt unit with a dismounting operation of said belt unit from said mounting portion.

12. An image heating apparatus according to claim 11, wherein said pad includes a heater configured to heat said endless belt.

13. An image heating apparatus according to claim 9, further comprising a coil configured to generate a magnetic flux for electromagnetic induction heating of said endless belt.

14. An image heating apparatus according to claim 9, wherein a dismounting direction of said belt unit from said mounting portion is a direction crossing the longitudinal direction of said endless belt.

15. An image heating apparatus according to claim 9, wherein said drive rotatable member is a roller.

* * * * *